US010393107B2

(12) United States Patent
Jeong et al.

(10) Patent No.: US 10,393,107 B2
(45) Date of Patent: Aug. 27, 2019

(54) PUMPING CONTROL UNIT AND METHOD OF COMPUTING A TIME-VARYING DOWNHOLE PARAMETER

(71) Applicant: General Electric Company, Schenectady, NY (US)

(72) Inventors: Younkoo Jeong, Clifton Park, NY (US); Ying Mao, Niskayuna, NY (US); Zengshi Chen, Missouri City, TX (US); Shyam Sivaramakrishnan, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 808 days.

(21) Appl. No.: 14/816,925

(22) Filed: Aug. 3, 2015

(65) Prior Publication Data

US 2017/0037846 A1 Feb. 9, 2017

(51) Int. Cl.

| | |
|---|---|
| ***F04B 51/00*** | (2006.01) |
| ***F04B 47/02*** | (2006.01) |
| ***E21B 43/12*** | (2006.01) |
| ***E21B 47/00*** | (2012.01) |
| ***F04B 9/04*** | (2006.01) |

(Continued)

(52) U.S. Cl.

CPC ..... *F04B 51/00* (2013.01); *E21B 43/126* (2013.01); *E21B 47/0007* (2013.01); *F04B 9/045* (2013.01); *F04B 47/026* (2013.01); *F04B 49/065* (2013.01); *F04B 49/20* (2013.01);

(Continued)

(58) Field of Classification Search

CPC ..... F04B 51/00; F04B 47/026; F04B 9/045; F04B 49/065; F04B 49/20; F04B 2201/0201; F04B 2201/1201; F04B 2201/121; E21B 43/126; E21B 47/0007

See application file for complete search history.

(56) References Cited

U.S. PATENT DOCUMENTS 3,343,409 A 9/1967 Gibbs
5,252,031 A 10/1993 Gibbs (Continued)

OTHER PUBLICATIONS

UNICO, Inc., "Sucker-Rod Pump Drive", no date, UNICO-Worldwide, pp. 1-3 accessed online Mar. 6, 2018 , http://www.unicous.com/sites/default/files/user_files/Products/SRP/SRP%207.13.pdf.*

Badoiu et al., "Research Concerning the Identification of Some Parameters of a Sucker Rod Pumping Unit", 2017, REV.CHIM 68 No. 10, pp. 2289-2292.*

(Continued)

*Primary Examiner* — Mischita L Henson

(74) *Attorney, Agent, or Firm* — Laura L. Pollander

(57) ABSTRACT

A pumping control unit is disclosed herein. The pumping control unit includes a processor coupled to a memory and a communication interface. The memory is configured to store an invariant matrix. The communication interface is configured to receive a plurality of measurements of a time-varying parameter for a rod pumping unit. The plurality of measurements is taken at a surface of a pumping site over a pump cycle for a sucker rod string. The processor is configured to gain access to the invariant matrix in the memory and the plurality of measurements from the communication interface. The processor is further configured to compute a Fourier coefficient array based on the invariant matrix and the plurality of measurements. The processor is further configured to compute a time-varying downhole parameter based on the Fourier coefficient array and a sucker rod string model.

20 Claims, 6 Drawing Sheets

(51) Int. Cl.
*F04B 49/06* (2006.01)
*F04B 49/20* (2006.01)

(52) U.S. Cl.
CPC . *F04B 2201/0201* (2013.01); *F04B 2201/121* (2013.01); *F04B 2201/1201* (2013.01)

(56) References Cited

U.S. PATENT DOCUMENTS

| | | | | |
|---|---|---|---|---|
| 7,168,924 | B2 * | 1/2007 | Beck | E21B 43/126 417/1 |
| 9,033,676 | B2 * | 5/2015 | Palka | E21B 43/127 417/44.1 |
| 2008/0240930 | A1 | 10/2008 | Palka et al. | |
| 2012/0130693 | A1 | 5/2012 | Ertas et al. | |
| 2013/0104645 | A1 | 5/2013 | Pons | |
| 2014/0196949 | A1 | 7/2014 | Hareland et al. | |

OTHER PUBLICATIONS

Everitt et al., "An Improved Finite-Difference Calculation of Downhole Dynamometer Cards for Sucker-Rod Pumps", SPE Production Engineering, vol. 7, Issue 1, pp. 121-127, Jan. 1992.

Lima et al., "Application of Fourier descriptors and Pearson correlation for fault detection in Sucker Rod pumping system",Proceeding ETFA'09 Proceedings of the 14th IEEE international conference on Emerging technologies & factory automation,pp. 754-757, 2009.

Souza et al., "Using artificial neural networks for pattern recognition of downhole dynamometer card in oil rod pump system",Proceedings of the 8th WSEAS Int. Conf. on Artificial Intelligence, Knowledge Engineering & Data Bases (AIKED '09), pp. 230-235, 2009.

Lima et al., "Comparison of Border Descriptors and Pattern Recognition Techniques Applied to Detection and Diagnose of Faults on Sucker-Rod Pumping System", Book Chapter 5 from "Digital Image Processing", Intech, pp. 91-109, Jan. 2012.

* cited by examiner

PUMPING CONTROL UNIT AND METHOD OF COMPUTING A TIME-VARYING DOWNHOLE PARAMETER

BACKGROUND

The field of the disclosure relates generally to downhole measurement systems and, more particularly, to systems and methods for computing downhole pump position and load.

Most known rod pumping units (also known as surface pumping units) are used in wells to induce fluid flow, for example oil and water. The primary function of the pumping unit is to convert rotating motion from a prime mover (e.g., an engine or an electric motor) into reciprocating motion above the wellhead. This motion is in turn used to drive a reciprocating down-hole pump via connection through a sucker rod string. The sucker rod string, which can extend miles in length, transmits the reciprocating motion from the wellhead at the surface to subterranean valves in a fluid bearing zone of the well. The reciprocating motion of the valves induces the fluid to flow up the length of the sucker rod string to the wellhead.

The rod pumping units are exposed to a wide range of conditions. These vary by well application, the type and proportions of the pumping unit's linkage mechanism, and the conditions of the well. Furthermore, well conditions, such as downhole pressure, may change over time. These conditions may cause variability in the flow of the fluid. In addition, these conditions affect the sucker rod string. The sucker rod string transmits dynamic loads from the downhole pump to the rod pumping unit. The sucker rod string behaves similarly to a spring over long distances. The sucker rod string elongates and retracts based on exposure to variable tensile stress. The response of the sucker rod string is damped somewhat due to its submergence in a viscous fluid (water and oil), but the motion profile of the rod pumping unit combined with the large variation of the load at the down-hole pump generally leaves little time for the oscillations to decay before the next perturbation is encountered.

The rod pumping unit imparts continually varying motion on the sucker rod string. The sucker rod string responds to the varying load conditions from the surface unit, down-hole pump, and surrounding environment by altering its own motion statically and dynamically. The sucker rod string stretches and retracts as it builds the force necessary to move the down-hole pump and fluid. The rod pumping unit, breaking away from the effects of friction and overcoming fluidic resistance and inertia, tends to generate counter-reactive interaction force to the sucker rod string exciting the dynamic modes of the sucker rod string, which causes an oscillatory response. Traveling stress waves from multiple sources interfere with each other along the sucker rod string (some constructively, others destructively) as they traverse its length and reflect load variations back to the rod pumping unit, where they can be measured. Translating measurements of these time-varying parameters, such as position and load, at the surface to downhole measurements is computationally intensive and typically involves use of partial differential equations, referred to as the wave equation. Consequently, computing time-varying downhole parameters is time consuming and complicates their use in controlling the rod pumping unit.

BRIEF DESCRIPTION

In one aspect, a system includes a pumping control unit. The pumping control unit includes a processor coupled to a memory and a communication interface. The memory is configured to store an invariant matrix. The communication interface is configured to receive a plurality of measurements of a time-varying parameter for a rod pumping unit. The plurality of measurements is taken at a surface of a pumping site over a pump cycle for a sucker rod string. The processor is configured to gain access to the invariant matrix in the memory and the plurality of measurements from the communication interface. The processor is further configured to compute a Fourier coefficient array based on the invariant matrix and the plurality of measurements. The processor is further configured to compute a time-varying downhole parameter based on the Fourier coefficient array and a sucker rod string model.

In another aspect, a method of computing a time-varying downhole parameter is provided. The method includes operating a rod pumping unit at W strokes per minute (SPM). The method further includes generating, according to W, a fixed quantity, N, of surface measurements of a time-varying parameter over a pumping cycle. The method further includes computing an array of Fourier coefficients based on the N surface measurements and an invariant matrix. The method further includes computing the time-varying downhole parameter based on the array of Fourier coefficients and a model of a sucker rod string represented as ordinary differential equations.

In yet another aspect, a control system for a sucker rod string is provided. The sucker rod string has a surface portion and a downhole portion. The control system includes a sensor and a pumping control unit. The sensor is configured to detect a time-varying parameter at the surface. The sensor is further configured to produce a plurality of measurements of the time-varying parameter over a pump cycle for the sucker rod string. The pumping control unit is configured to operate the sucker rod string at W strokes-per-minute (SPM). The pumping control unit is further configured to store an invariant matrix. The pumping control unit is further configured to compute a Fourier coefficients array based on the invariant matrix and the plurality of measurements. The pumping control unit is further configured to compute a time-varying downhole parameter based on the Fourier coefficients array and the ODE model.

DRAWINGS

These and other features, aspects, and advantages of the present disclosure will become better understood when the following detailed description is read with reference to the accompanying drawings in which like characters represent like parts throughout the drawings, wherein.

Figure 1:
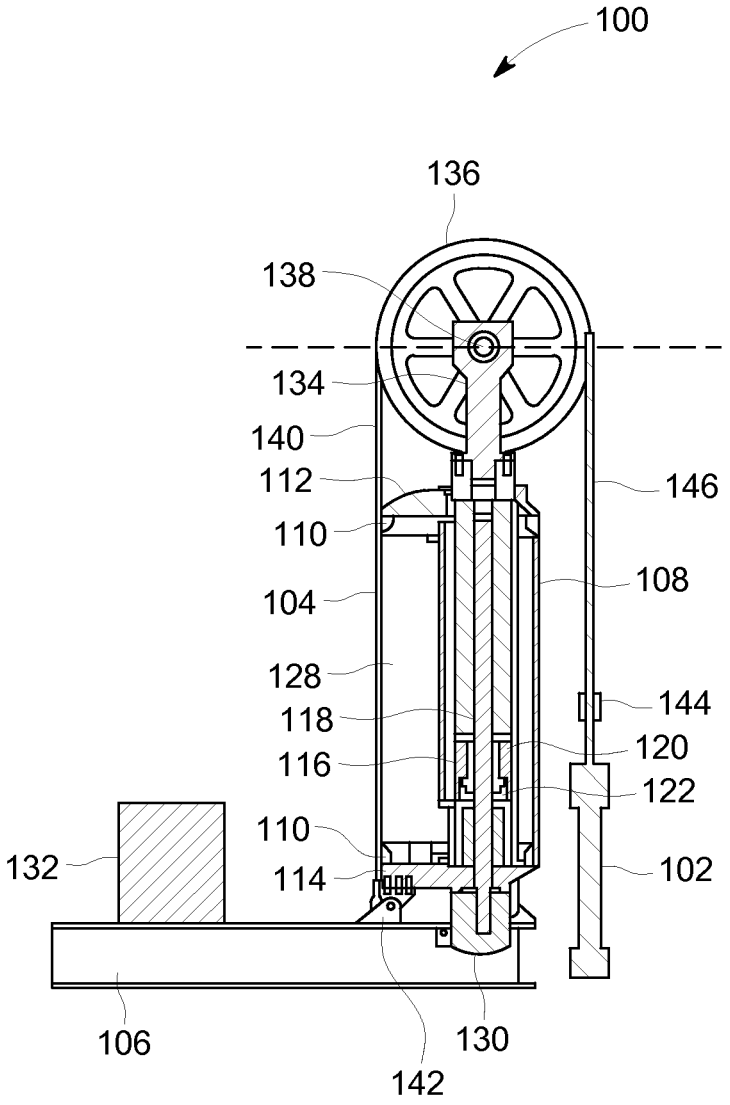
FIG. 1 is a cross-sectional view of an exemplary rod pumping unit in a fully retracted position.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, a number of terms are referenced that have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program stored in memory for execution by personal computers, workstations, clients and servers.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Furthermore, as used herein, the term "real-time" refers to at least one of the time of occurrence of the associated events, the time of measurement and collection of predetermined data, the time to process the data, and the time of a system response to the events and the environment. In the embodiments described herein, these activities and events occur substantially instantaneously.

The pumping control unit as described herein provides a method for controlling a rod pumping unit to enhance the flow of a fluid induced by the rod pumping unit based on downhole measurements of time-varying parameters. More specifically, the control system described herein computes downhole measurements of time-varying parameters using ordinary differential equations in real time. Furthermore, the downhole measurements can be used to control the rod pumping unit to ensure that the motion of the sucker rod string will not damage the sucker rod string, the rod pumping unit, or the well itself.

Figure 2:
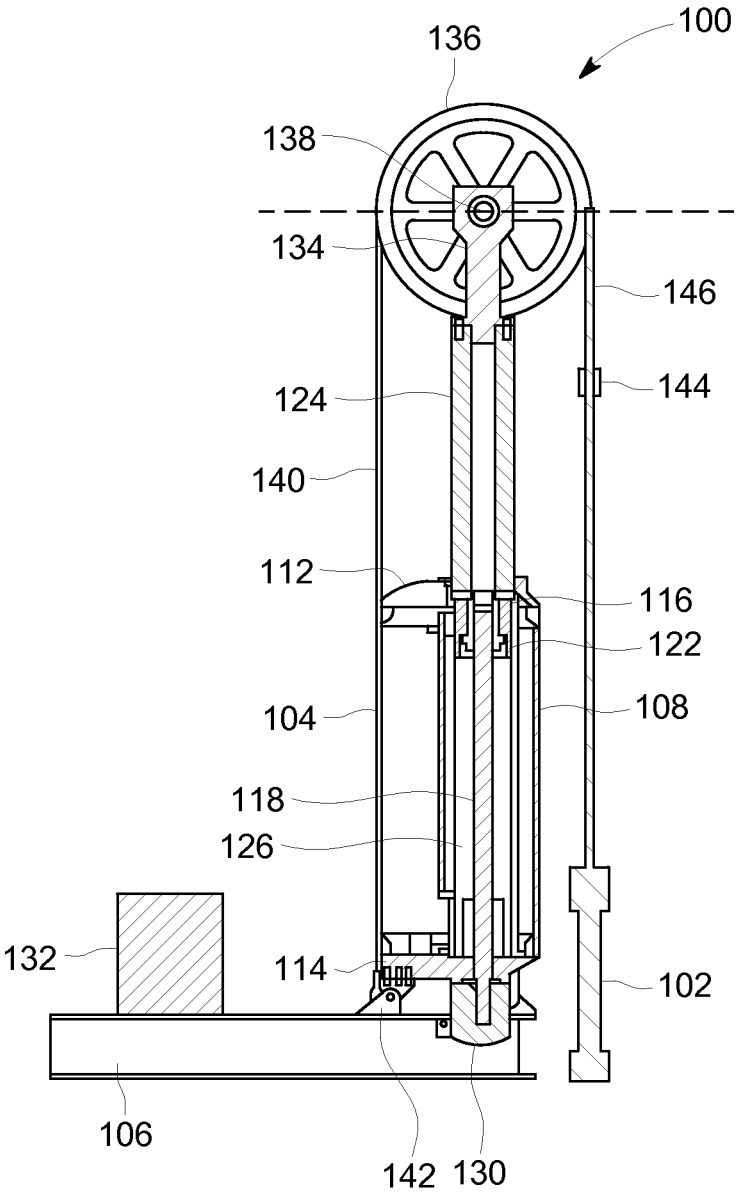
FIG. 2 is a cross-sectional view of the rod pumping unit shown in FIG. 1 in a fully extended position.

FIGS. 1 and 2 are cross-sectional views of an exemplary rod pumping unit 100 in fully retracted (1) and fully extended (2) positions. In the exemplary embodiment, rod pumping unit 100 (also known as a linear pumping unit) is a vertically oriented rod pumping unit having a linear motion vertical vector situated adjacent a wellhead 102. In alternative embodiments, rod pumping unit 100 includes a beam pumping unit (not shown). Rod pumping unit 100 is configured to transfer vertical linear motion into a subterranean well (not shown) through a sucker rod string (not shown) for inducing the flow of a fluid. Rod pumping unit 100 includes a pressure vessel 104 coupled to a mounting base structure 106. In some embodiments, mounting base structure 106 is anchored to a stable foundation situated adjacent the fluid-producing subterranean well. Pressure vessel 104 may be composed of a cylindrical or other appropriately shaped shell body 108 constructed of formed plate and cast or machined end flanges 110. Attached to end flanges 110 are upper and lower pressure heads 112 and 114, respectively.

Penetrating upper and lower pressure vessel heads 112 and 114, respectively, is a linear actuator assembly 116. This linear actuator assembly 116 includes a vertically oriented threaded screw 118 (also known as a roller screw), a planetary roller nut 120 (also known as a roller screw nut assembly), a forcer ram 122 in a forcer ram tube 124, and a guide tube 126.

Roller screw 118 is mounted to an interior surface 128 of lower pressure vessel head 114 and extends to upper pressure vessel head 112. The shaft extension of roller screw 118 continues below lower pressure vessel head 114 to connect with a compression coupling (not shown) of a motor 130. Motor 130 is coupled to a variable speed drive (VSD) (not shown) configured such that the motor's 130 rotating speed may be adjusted continuously. The VSD also reverses the motor's 130 direction of rotation so that its range of torque and speed may be effectively doubled. Roller screw 118 is operated in the clockwise direction for the upstroke and the counterclockwise direction for the downstroke. Motor 130 is in communication with a pumping unit controller 132. In the exemplary embodiment, pumping unit controller 132 transmits commands to motor 130 and the VSD to control the speed, direction, and torque of roller screw 118.

Within pressure vessel 104, the threaded portion of roller screw 118 is interfaced with planetary roller screw nut assembly 120. Nut assembly 120 is fixedly attached to the lower segment of forcer ram 122 such that as roller screw 118 rotates in the clockwise direction, forcer ram 122 moves upward. Upon counterclockwise rotation of roller screw 118, forcer ram 122 moves downward. This is shown generally in FIGS. 1 and 2. Guide tube 126 is situated coaxially surrounding forcer tube 124 and statically mounted to lower pressure head 114. Guide tube 126 extends upward through shell body 108 to slide into upper pressure vessel head 112.

An upper ram 134 and a wireline drum assembly 136 are fixedly coupled and sealed to the upper end of forcer ram 122. Wireline drum assembly 136 includes an axle 138 that passes laterally through the top section of the upper ram 134. A wireline 140 passes over wireline drum assembly 136 resting in grooves machined into the outside diameter of wireline drum assembly 136. Wireline 140 is coupled to anchors 142 on the mounting base structure 106 at the side of pressure vessel 104 opposite wellhead 102. At the wellhead side of pressure vessel 104, wireline 140 is coupled to a carrier bar 144 which is in turn coupled to a polished rod 146 extending from wellhead 102.

Rod pumping unit 100 transmits linear force and motion through planetary roller screw nut assembly 120. Motor 130 is coupled to the rotating element of planetary roller screw nut assembly 120. By rotation in either the clockwise or counterclockwise direction, motor 130 may affect translatory movement of planetary roller nut 120 (and by connection, of forcer ram 122) along the length of roller screw 118.

Figure 3:
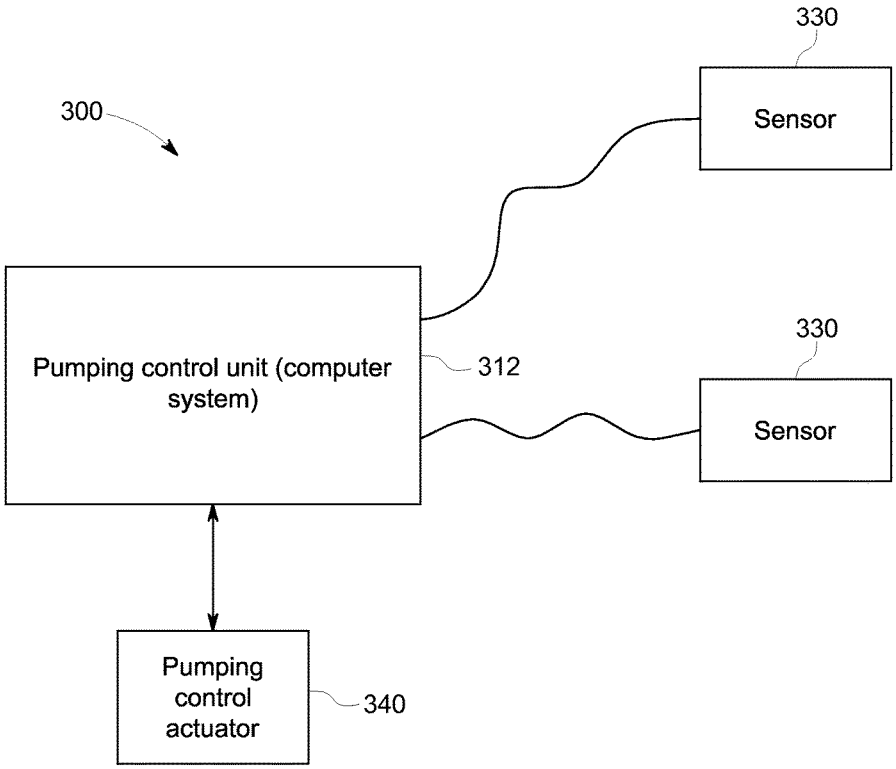
FIG. 3 is a schematic view of a system for controlling the rod pumping unit shown in FIGS. 1 and 2.

FIG. 3 is a schematic view of a system 300 for controlling rod pumping unit 100 (shown in FIGS. 1 and 2). In the exemplary embodiment, system 300 is used for compiling and responding to data from a plurality of sensors 330 and controlling the stroke of rod pumping unit 100. A stroke of rod pumping unit 100 represents the distance that it takes rod pumping unit 100 to extend from fully retracted to fully extended and back to fully retracted, as shown in FIGS. 1 and 2. Sensors 330 are in communication with a pumping control unit 312. Sensors 330 connect to pumping control unit 312 through many interfaces including without limitation a network, such as a local area network (LAN) or a wide area network (WAN), dial-in-connections, cable modems, Internet connection, wireless, and special high-speed Integrated Services Digital Network (ISDN) lines. Sensors 330 receive data about conditions of rod pumping unit 100 and report those conditions to pumping control unit 312. Sensors 330 include, for example, and without limitation, a load sensor and a position sensor. Pumping control unit 312 may include, but is not limited to, pumping unit controller 132 (shown in FIG. 1).

Pumping control unit 312 is in communication with pumping control actuator 340. In the exemplary embodiment, pumping control actuator 340 includes motor 130 (shown in FIG. 1) and a VSD (not shown). Pumping control actuator 340 transmits data to pumping control unit 312 and receives commands from pumping control unit 312. Pumping control actuator 340 connects to pumping control unit 312 through many interfaces including without limitation a network, such as an analog-to-digital converter, an encoder interface, a local area network (LAN) or a wide area network (WAN), dial-in-connections, cable modems, Internet connection, wireless, and special high-speed Integrated Services Digital Network (ISDN) lines.

Figure 4:
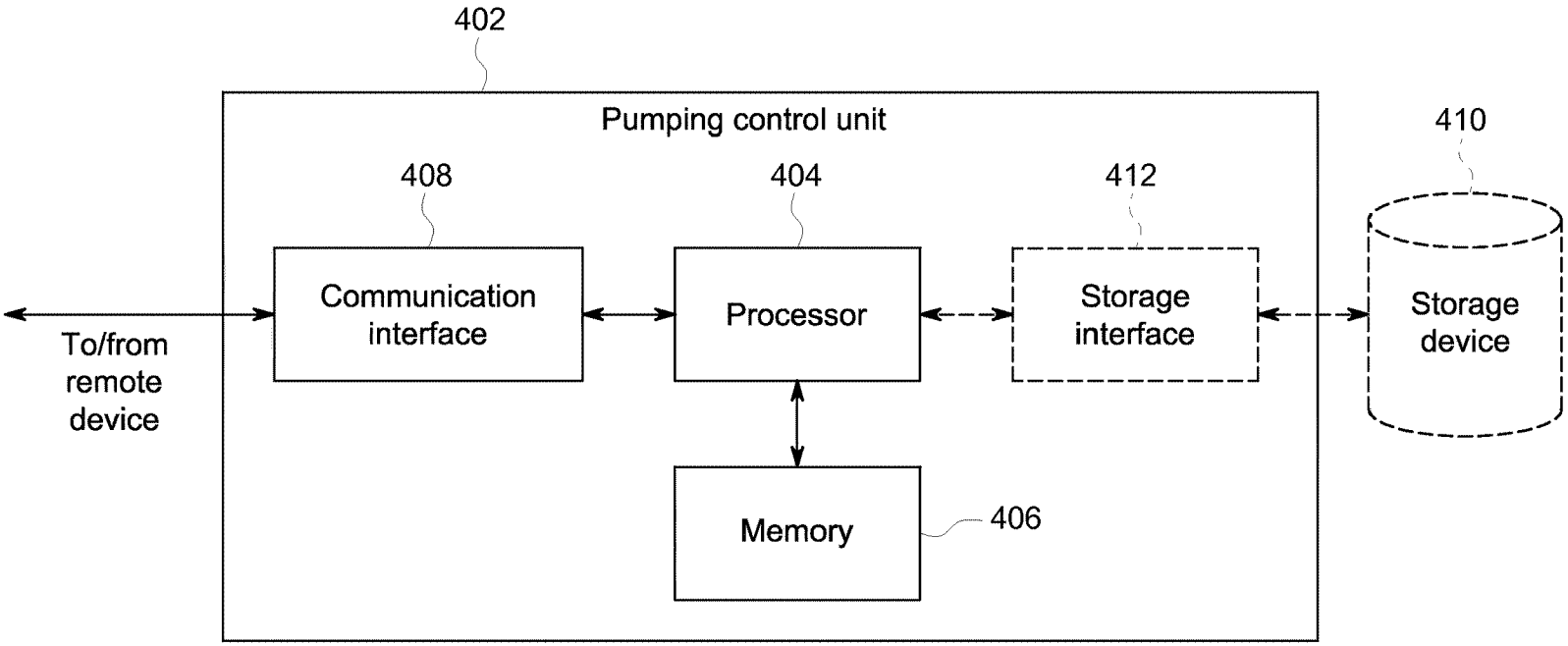
FIG. 4 is a schematic view of an exemplary configuration of a pumping control unit that may be used with the system shown in FIG. 3.

FIG. 4 is a schematic view of an exemplary configuration of a pumping control unit 402 that may be used with system 300 (shown in FIG. 3). More specifically, pumping control unit 402 includes a processor 404 for executing instructions. Instructions are stored in a memory 406. Processor 404 may include one or more processing units (e.g., in a multi-core configuration).

Processor 404 is operatively coupled to a communication interface 408 through which pumping control unit 402 is capable of communicating with a remote device (not shown), such as another computing device, sensors 330 (shown in FIG. 3), or pumping control actuator 340 (shown in FIG. 3). For example, communication interface 408 may receive requests from a client system (not shown). In alternative embodiments, communication interface 408 includes a data acquisition interface (not shown).

Processor 404 is also operatively coupled to a storage device 410. Storage device 410 is any computer-operated hardware suitable for storing and/or retrieving data, such as, but not limited to, data associated with a database (not shown). In some embodiments, storage device 410 is integrated in pumping control unit 402. For example, pumping control unit 402, in such embodiments, may include one or more hard disk drives as storage device 410. In other embodiments, storage device 410 is external to pumping control unit 402 and is accessed by one or more pumping control units 402. For example, storage device 410 may include a storage area network (SAN), a network attached storage (NAS) system, and/or multiple storage units such as hard disks and/or solid state disks in a redundant array of inexpensive disks (RAID) configuration.

In some embodiments, processor 404 is operatively coupled to storage device 410 via a storage interface 412. Storage interface 412 is any component capable of providing processor 404 with access to storage device 410. Storage interface 412 may include, for example, an Advanced Technology Attachment (ATA) adapter, a Serial ATA (SATA) adapter, a Small Computer System Interface (SCSI) adapter, a RAID controller, a SAN adapter, a network adapter, and/or any component providing processor 404 with access to storage device 410.

Processor 404 executes computer-executable instructions for implementing aspects of this disclosure. In some embodiments, the processor 404 is transformed into a special purpose microprocessor by executing computer-executable instructions or by otherwise being programmed. For example, the processor 404 is programmed with instructions as described further below.

Processor 404 is configured to compute a downhole measurement of a time-varying parameter, such as, for example, and without limitation, downhole position and downhole load. Downhole measurements of time-varying parameters are computed using a mathematical model of the sucker rod string. Fourier coefficients for the mathematical model are found by using surface measurements as boundary conditions. Once the Fourier coefficients are known, the Fourier coefficients representing the model of the surface measurement, the dynamic model of the sucker rod in the form of a series of ordinary differential equations is used to compute the downhole measurement.

Memory 406 is configured to store an invariant matrix. The invariant matrix has dimensions of $(2m+1)\times N$. N represents a size of a surface measurement data set, and m represents a number of dynamic modes included in the periodic approximation model of the surface measurement, such as a Fourier series. The dimensions of the invariant matrix are fixed and depend on the size of the data set used to solve the model for the Fourier coefficients. The data set includes surface measurements over a pump cycle. Sensors 330 are typically configured to take measurements at the surface at a given fixed rate. However, the rod pumping unit operates at a variable speed, W. To maintain the N dimension of the invariant matrix under varying pump speed W, the rate at which sensors 330 take surface measurements varies, or the surface measurements are manipulated to arrive at N measurements. In some embodiments, a plurality of surface measurements of the time-varying parameter during a pump cycle is re-sampled using interpolation or extrapolation to arrive at N measurements. The other dimension of the invariant matrix, (2m+1), is a number of dynamic modes considered for the approximation model, which is reduced to a Fourier series expansion. (2m+1) corresponds to a quantity of Fourier series coefficients in the model.

Figure 5:
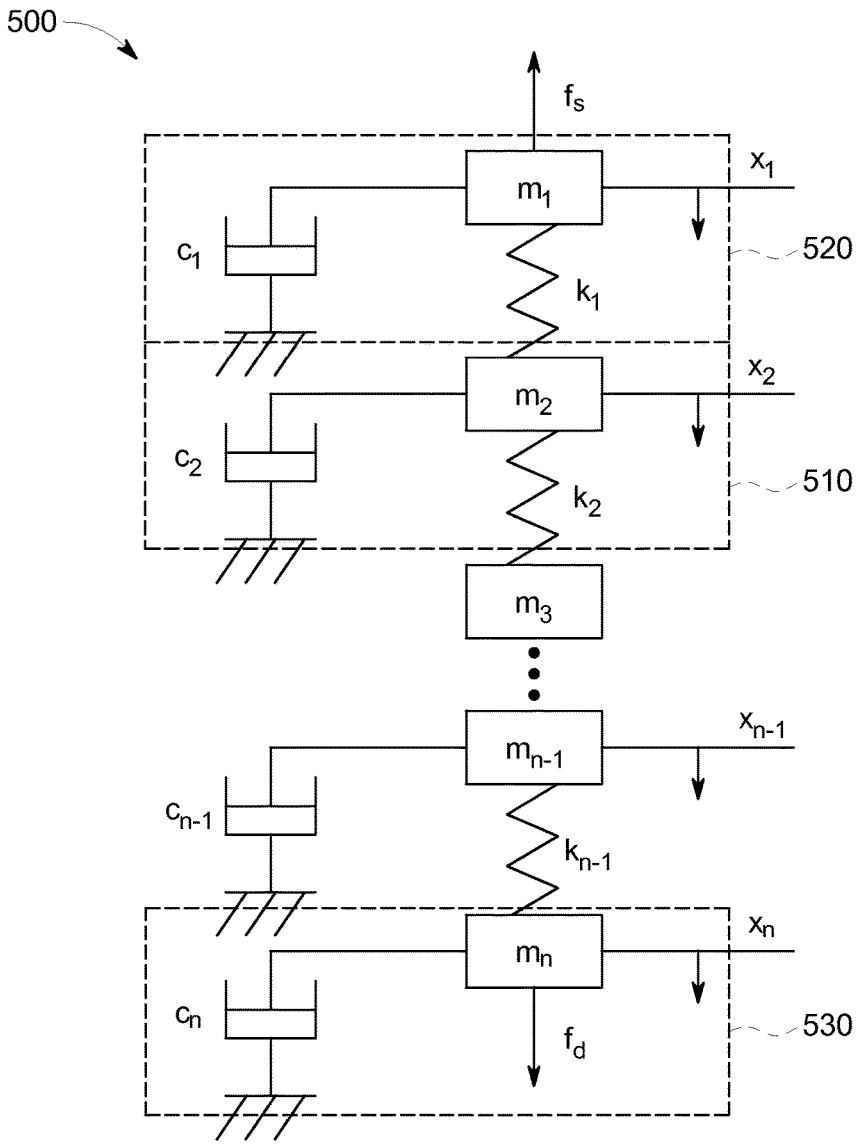
FIG. 5 is a schematic diagram of an exemplary model of a sucker rod string.

FIG. 5 is a schematic diagram of an exemplary lumped parameter model 500 of a sucker rod string using a series of lumped parameter models that may be represented by ordinary differential equations. Lumped parameter model 500 includes a series of n sucker rod sections, such as section 510. Each section includes a lumped mass, m, a spring, k, and a damper, c. For example, and without limitation, section 510 is a second section in lumped parameter model 500 at a position $x_2$. Section 510 includes a lumped mass $m_2$, a spring $k_2$, and a damper $c_2$. Lumped mass $m_2$ is coupled to a first section 520 that includes a lumped mass $m_1$, a spring $k_1$, and a damper $c_1$. Lumped mass $m_2$ is coupled to spring $k_1$ of first section 520. First section 520 is an uppermost section of the sucker rod and is located at the surface of the pumping site. First section 520 is at a position $x_1$, and under a load $f_s$. Position $x_1$ is referred to as a surface position and load $f_s$ is referred to as a surface load.

Lumped parameter model 500 includes a lowest section referred to as the downhole section, or $n^{th}$ section 530. $n^{th}$ section 530 includes a lumped mass $m_n$ and a damper $c_n$, but is modeled without a spring because no further sections are present below nth section 530. $n^{th}$ section 530 is at a position $x_n$ and is under a load of $f_d$. Position $x_n$ is referred to as a downhole position and load $f_d$ is referred to as a downhole load.

Solving for position $x_n$ and load $f_n$ at a time, t, each involves a chain of differentiation that can be modeled as a truncated Fourier series:

$$x_n(t)=a_0+\Sigma_{i=1}^{m} a_i \sin(iWt)+b_i \cos(iWt), \quad \text{Eq. (1)}$$

where, $a_0$, $a_i$, and $b_i$ are Fourier series coefficients, $x_n(t)$ is the position of the $n^{th}$ sucker rod section at time, t, and W is the speed of the rod pumping unit in radians per second.

Solving for Fourier series coefficients $a_0$, $a_i$, and $b_i$ for a given time-varying parameter is achieved using ordinary differential equations. Surface measurements of the time-varying parameter are used as boundary conditions. For example, the Fourier series expansion above, for surface position, can be simplified to the equation:

$$M_{coeff}\begin{bmatrix} b_0 \\ a_1 \\ b_1 \\ \vdots \\ a_m \\ b_m \end{bmatrix} = \begin{bmatrix} x_1(t_1) \\ x_1(t_2) \\ \vdots \\ x_1(t_N) \end{bmatrix}, \quad \text{Eq. (2)}$$

where, $M_{coeff}$ is a coefficient matrix of dimensions N×(2m+1), N is a quantity of surface measurements in a pump cycle, and m is a quantity of Fourier series coefficients in the model.

The pseudo-inverse of the coefficient matrix, $M_{coeff}$, can be solved using the least-square method and does not vary with the speed of the rod pumping unit, W. Given $M_{coeff}$, the array of Fourier series coefficients can be solved according to the equation:

$$\begin{bmatrix} b_0 \\ a_1 \\ b_1 \\ \vdots \\ a_m \\ b_m \end{bmatrix} = (M_{coeff}^T \times M_{coeff})^{-1} M_{coeff}^T \begin{bmatrix} x_1(t_1) \\ x_1(t_2) \\ \vdots \\ x_1(t_N) \end{bmatrix}, \quad \text{Eq. (3)}$$

The matrix described by the expression $(M_{coeff}^T \times M_{coeff})^{-1} M_{coeff}^T$ is referred to as an invariant matrix.

In certain embodiments, the invariant matrix is computed offline by a remote computing device and loaded into memory 406 of pumping control unit 402. Processor 404 gains access to memory 406 and the invariant matrix, and computes the Fourier series coefficients using the surface measurements, $x_1$, taken over a pump cycle. In alternative embodiments, the invariant matrix is stored on storage device 410. In such an embodiment, processor 404 gains access to the invariant matrix through storage interface 412. Processor 404 computes the Fourier series coefficients in real time using multiplication and summation operations. Processor 404 is further configured to use the computed Fourier series coefficients to compute downhole measurements of the time-varying parameter using lumped parameter model 500 of the sucker rod string.

Figure 6:
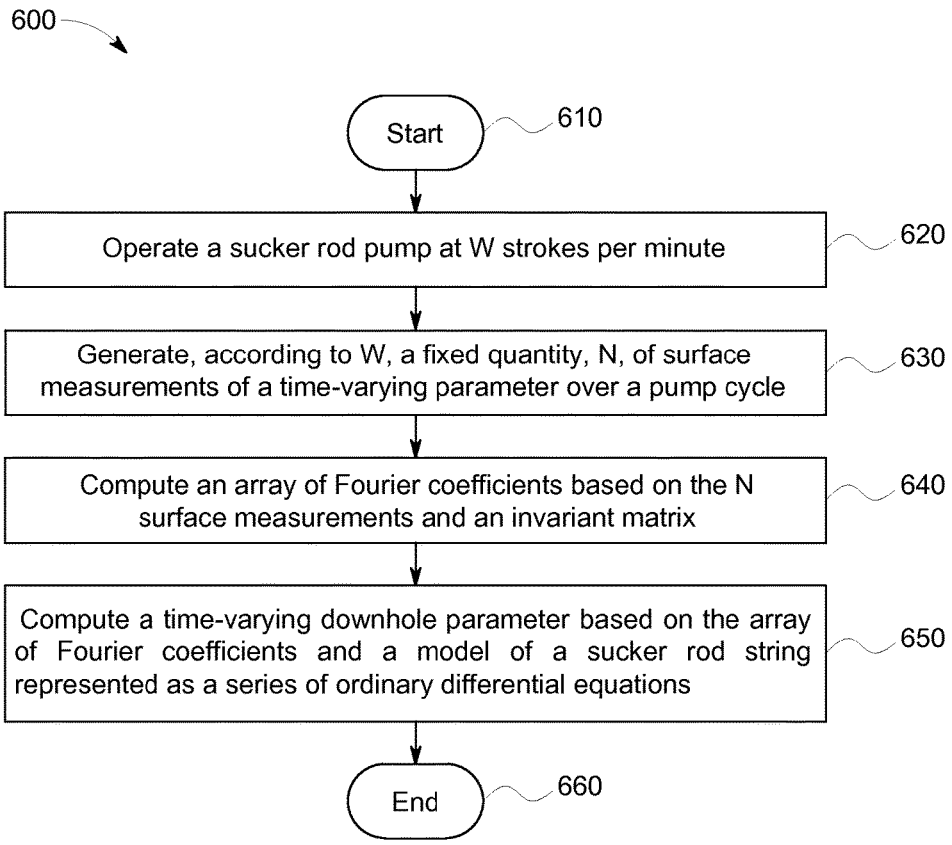
FIG. 6 is a flow diagram of an exemplary method of computing a time-varying downhole parameter.

FIG. 6 is a flow diagram of an exemplary method of computing a time-varying downhole parameter. The method begins at a start step 610. At an operating step 620, rod pumping unit 100 is operated at a speed of W strokes per minute. At a surface measurement step 630, N surface measurements of a time-varying parameter over a pump cycle are generated. Surface measurements are taken by sensors 330 and are used by pumping control unit 402. The number of surface measurements taken by sensors 330 may be more or less than N for a given pump speed W. In certain embodiments, the rate at which sensors 330 collect measurements is varied according to pump speed W to produce the necessary quantity, N, of surface measurements in a pump cycle. In other embodiments, sensors 330 collect a fixed number of measurements in a pump cycle and processor 404 is configured to re-sample the surface measurements to arrive at N surface measurements for the pump cycle.

At a coefficient computation step 640, processor 404 is configured to compute an array of Fourier coefficients based on the N surface measurements and an invariant matrix. The invariant matrix, in certain embodiments, is stored on memory 406. In other embodiments, the invariant matrix is stored on storage device 410. At a downhole measurement step 650, processor 404 is configured to compute a downhole measurement of the time-varying parameter based on the array of Fourier coefficients and lumped parameter model 500 of the sucker rod string. The method ends at an end step 660.

The above-described pumping control unit and method of computing a time-varying downhole parameter provide a computationally efficient control system for controlling a rod pumping unit to enhance the flow of a fluid induced by the rod pumping unit based downhole measurements of time-varying parameters. More specifically, the control system described herein computes downhole measurements of time-varying parameters using ordinary differential equations in real time. Furthermore, the downhole measurements can be used to control the rod pumping unit to ensure that the motion of the sucker rod string will not damage the sucker rod string, the rod pumping unit, or the well itself.

An exemplary technical effect of the methods, systems, and apparatus described herein includes at least one of: (a) computing downhole load and position measurements in real time; (b) improving computational efficiency in controlling a rod pumping unit; (c) simplifying pump control and monitoring techniques; (d) reducing life cycle costs of pump sucker rod strings; (e) reducing likelihood of damage to sucker rod string, rod pumping unit, and well during operation.

Exemplary embodiments of pumping control units and methods computing a time-varying downhole parameter are described above in detail. The systems and methods described herein are not limited to the specific embodiments described herein, but rather, components of systems or steps of the methods may be utilized independently and separately from other components or steps described herein. For example, the methods may also be used in combination with other linear pumping units, and are not limited to practice with only linear pumping units as described herein. Rather, the exemplary embodiments may be implemented and utilized in connection with many other pumping control applications.

Although specific features of various embodiments may be shown in some drawings and not in others, this is for convenience only. In accordance with the principles of the systems and methods described herein, any feature of a drawing may be referenced or claimed in combination with any feature of any other drawing.

Some embodiments involve the use of one or more electronic or computing devices. Such devices typically include a processor, processing device, or controller, such as a general purpose central processing unit (CPU), a graphics processing unit (GPU), a microcontroller, a reduced instruction set computer (RISC) processor, an application specific integrated circuit (ASIC), a programmable logic circuit (PLC), a field programmable gate array (FPGA), a digital signal processing (DSP) device, and/or any other circuit or processing device capable of executing the functions described herein. The methods described herein may be encoded as executable instructions embodied in a computer readable medium, including, without limitation, a storage device and/or a memory device. Such instructions, when executed by a processing device, cause the processing device to perform at least a portion of the methods described herein. The above examples are exemplary only, and thus are not intended to limit in any way the definition and/or meaning of the term processor and processing device.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A pumping control unit, comprising:

at least one sensor comprising at least one of a load sensor and a position sensor, wherein the at least one sensor is configured to take at least one surface measurement;

a memory configured to store an invariant matrix;

a communication interface configured to receive a plurality of measurements from the at least one sensor of a time-varying parameter for a rod pumping unit, said plurality of measurements taken at a surface of a pumping site over a pump cycle for a sucker rod string; and a processor coupled to said memory and said communication interface, said processor configured to, in real time:

gain access to the invariant matrix in said memory and the plurality of measurements from said communication interface;

compute a Fourier coefficient array based on the invariant matrix and the plurality of measurements from the at least one sensor;

compute a time-varying downhole parameter based on the coefficient array and a sucker rod string model; and adjust the rod pumping unit based upon the time-varying downhole parameter.

2. The pumping control unit according to claim 1, wherein said memory is further configured to store the invariant matrix in an invariant matrix data structure comprising a plurality of memory spaces respectively corresponding to a plurality of Fourier coefficients for the time-varying parameter, wherein each of said plurality of memory spaces comprises a quantity, N, of memory positions respectively corresponding to N measurements of the time-varying parameter over the pump cycle for the sucker rod string.

3. The pumping control unit according to claim 2, wherein said processor is further configured to re-sample the plurality of measurements to produce the N measurements of the time-varying parameter over a pump cycle.

4. The pumping control unit according to claim 2, wherein the plurality of measurements consists of the N measurements of the time-varying parameter, and wherein the processor comprises at least one of a graphics processing unit (GPU), a reduced instruction set computer (RISC), an application specific integrated circuit (ASIC), a field programmable gate array (FPGA), a digital signal processing (DSP) device, and a programmable logical circuit (PLC).

5. The pumping control unit according to claim 4, wherein said processor is further configured to determine a sampling rate for the time-varying parameter based on a strokes-per-minute (SPM) of the rod pumping unit to provide the N measurements of the time-varying parameter, wherein the processor comprises an application specific integrated circuit (ASIC).

6. The rod pumping control unit according to claim 1, wherein the sucker rod string model comprises lumped-parameter model having a quantity, n, of sections of the sucker rod string in ordinary differential equations, and wherein the at least one sensor comprises at least one of a load sensor and a position sensor wherein the rod pumping control unit further comprises as least one sensor.

7. The pumping control unit according to claim 6, wherein said processor is further configured to compute the time varying downhole parameter using the coefficient array in the Fourier series expansion and the lumped-parameter model.

8. The pumping control unit according to claim 1, wherein the time-varying parameter is selected from the group consisting of sucker rod string position and sucker rod string load.

9. A method of computing a time-varying downhole parameter, said method comprising:

operating a rod pumping unit at W strokes per minute (SPM);

generating, according to W, a fixed quantity, N, of surface measurements of a time-varying parameter over a pump cycle;

sensing, using at least one sensor comprising at least one of a load sensor and a position sensor, at least one surface measurement from a pumping site over the pump cycle for a sucker rod string;

computing, using the at least one surface measurement sensed by the sensor, an array of Fourier coefficients based on the N surface measurements and an invariant matrix, the invariant matrix having fixed dimensions;

computing the time-varying downhole parameter based on the array of Fourier coefficients and a model of a sucker rod string represented as a series of ordinary differential equations, wherein each stroke of the rod pumping unit represents the distance that it takes the rod pumping unit to extend from a fully retracted position to a fully extended position and back to the fully retracted position;

and adjusting the rod pumping unit based upon the time-varying downhole parameter.

10. The method according to claim 9 further comprising computing the Fourier coefficients using a least squared error method, wherein computing the time-varying downhole parameter further comprises computing the time-varying downhole parameter via at least one of a graphics processing unit (GPU), a reduced instruction set computer (RISC), an application specific integrated circuit (ASIC), a field programmable gate array (FPGA), a digital signal processing (DSP) device, and a programmable logical circuit (PLC).

11. The method according to claim 9, wherein the downhole parameter comprises a parameter selected from the group consisting of sucker rod string position and sucker rod string load.

12. The method according to claim 9, wherein generating the N surface measurements comprises:

taking a plurality of surface measurements over a pump cycle; and re-sampling the plurality of surface measurements to generate the N surface measurements.

13. The method according to claim 9, wherein computing the array of Fourier coefficients comprises multiplying the invariant matrix by the N surface measurements.

14. The method according to claim 9, wherein computing the downhole parameter comprises:

modeling the sucker rod string as a Fourier series expansion; and using the array of Fourier coefficients for surface measurements and the Fourier series expansion to compute the time-varying downhole parameter.

15. The method according to claim 9 further comprising varying W over time, and holding N constant.

16. A control system for a sucker rod string having a surface portion and a downhole portion, said control system comprising:

a sensor configured to detect a time-varying parameter at the surface, said sensor further configured to produce a plurality of measurements of the time-varying parameter over a pump cycle for the sucker rod string;

a pumping control unit for operating the sucker rod string at W strokes-per-minute (SPM), said pumping control unit configured to:

store an invariant matrix for computation of Fourier coefficients;

compute a Fourier coefficients array based on the invariant matrix and the plurality of measurements from the sensor;

compute a time-varying downhole parameter based on the Fourier coefficients array and a sucker rod string model; and adjust the rod pumping unit based upon the time-varying downhole parameter.

17. The control system according to claim 16, wherein the sucker rod string model is expressed as a series of ordinary differential equations, and wherein the control system further comprises a sucker rod string comprising:

a surface portion; and a downhole portion.

18. The control system according to claim 16, further comprising a pumping control actuator, the pumping control actuator communicatively coupled to the pumping control unit, wherein said pumping control unit comprises a memory configured to store the invariant matrix as an (2m+1) by N matrix, and wherein:

N is a fixed quantity of surface samples per pump cycle of the time-varying parameter; and m is an order of Fourier series coefficients; and wherein the pumping control actuator adjusts the movement of the sucker rod string based on at least one input from the pumping control unit.

19. The control system according to claim 18, wherein said pumping control unit is further configured to re-sample the plurality of measurements of the time-varying parameter to generate the N surface samples per pump cycle.

20. The control system according to claim 18, wherein the time-varying parameter is selected from the group consisting of sucker rod string position and sucker rod string load.

* * * * *